United States Patent [19]

Sakamoto

[11] Patent Number: 5,027,409

[45] Date of Patent: Jun. 25, 1991

[54] APPARATUS FOR ELECTRONICALLY OUTPUTTING A VOICE AND METHOD FOR OUTPUTTING A VOICE

[75] Inventor: Yumi Sakamoto, Suwa, Japan

[73] Assignee: Seiko Epson Corporation, Tokyo, Japan

[21] Appl. No.: 350,173

[22] Filed: May 10, 1989

[30] Foreign Application Priority Data

May 10, 1988 [JP] Japan ..... 63-113012
Dec. 21, 1988 [JP] Japan ..... 63-323067

[51] Int. Cl.[5] ..... G10L 5/00

[52] U.S. Cl. ..... 381/51; 364/513.5; 368/63

[58] Field of Search ..... 381/51-53; 364/513.5; 368/63

[56] References Cited

U.S. PATENT DOCUMENTS 3,641,496 6/1969 Slavin .
4,214,125 1/1977 Mozer et al. .
4,266,096 5/1981 Inoue et al. ..... 381/55

*Primary Examiner*—Emanuel S. Kemeny
*Attorney, Agent, or Firm*—Blum Kaplan

[57] ABSTRACT

An apparatus for audibly outputting a series of numbers represented by words and divided into blocks includes a voice data memory group for storing voice data. The voice data memory group includes a commonly used memory for storing voice data which may be utilized for any of the blocks, word ending memory for storing voice data corresponding to word endings which have a distinct intonation dependent upon for which block they are to be used and a block only memory for storing block specific voice data. A block voice selecting unit selects the memory from which the voice data is to be output from among the common use memory, word ending memory and the block only memory in accordance with the block type and the number to be output.

15 Claims, 11 Drawing Sheets

FIG. 4

| NUMBER \ table | table D1 | table D2 | table D3 |
|---|---|---|---|
| 0 | NULL | | |
| 1 | EIN | | ein |
| 2 | ZWEI | zwan | zwei |
| 3 | DREI | drei- | drei |
| 4 | VIER | vier- | vier |
| 5 | FÜNF | fünf- | fünf |
| 6 | SECHS | sech- | sechs |
| 7 | SIEBEN | sieb- | sieben |
| 8 | ACHT | acht- | acht |
| 9 | NEUN | neun- | neun |
| 10 | ZEHN | | zehn |
| 11 | ELF | | elf |
| 12 | ZWÖLF | | zwölf |

FIG. 5

| table D4 | table D5 | table D6 |
|---|---|---|
| zehn-1 | zehn-2 | und |
| zig-1 | zig-2 | uhr |
| big-1 | big-2 | MARK |

FIG. 8

| table E4 | table E5 |
|---|---|
| teen-1 | teen-2 |
| ty-11 | ty-21 |
| ty-12 | ty-22 |

FIG. 11

| table Es5 | table Es6 | table Es7 |
|---|---|---|
| ce-1 | Ce-2 | más |
| ta-1 | ta-2 | menos |
| ta y-1 | ta y-2 | por |
| | | entre |
| | | igual a |

FIG. 7

| NUMBER \ table | table E1 | table E2 | table E3 |
|---|---|---|---|
| 0 | | | oh |
| 1 | ONE | | one |
| 2 | TWO | Twen- | two |
| 3 | THREE | Thir- | three |
| 4 | FOUR | Four- | four |
| 5 | FIVE | Fif- | five |
| 6 | SIX | Six- | six |
| 7 | SEVEN | Seven- | seven |
| 8 | EIGHT | Eight- | eight |
| 9 | NINE | Nine | nine |
| 10 | TEN | | ten |
| 11 | ELEVEN | | eleven |
| 12 | TWELVE | | twelve |

FIG. 10

| NUMBER \ table | table Es1 | table Es2 | table Es3 | table Es4 |
|---|---|---|---|---|
| 0 | CERO | | | cero |
| 1 | UNA | | dieci- | uno |
| 2 | DOS | Veinte | veinti- | dos |
| 3 | TRES | Trein - | trein- | tres |
| 4 | CUATRO | Cuaren- | cuaren- | cuatro |
| 5 | CINCO | Cincuen- | cincuen- | cinco |
| 6 | SEIS | Sesen- | sesen- | seis |
| 7 | SIETE | Seten- | seten- | siete |
| 8 | OCHO | Ochen- | ochen- | ocho |
| 9 | NUEVE | Noven- | noven- | nueve |
| 10 | DIEZ | | | diez |
| 11 | | On- | | |
| 12 | | Do- | | |
| 13 | | Tre- | | |
| 14 | | Cator- | | |
| 15 | | Quin- | | |

APPARATUS FOR ELECTRONICALLY OUTPUTTING A VOICE AND METHOD FOR OUTPUTTING A VOICE

BACKGROUND OF THE INVENTION

The present invention relates to an apparatus for electronically outputting a voice, and in particular, audio compilation within a voice output apparatus adapted to audibly output numbers.

Electronic audio output devices are known in the art as exemplified by Japanese Utility Model Publication No. 63-4239 which discloses a system for Japanese audio time notification for an electronic clock. In this system each output is divided into word blocks such as, hours and minutes. Voice data is stored in a dedicated voice data memory provided for each unit block. Data is then output for each distinct block. In the Japanese language, the system has two "ju" (ten) word sounds for outputting numbers containing a tens digit, using the appropriate "ju" word sound depending on the placement of the tens digit. For the numbers 20 through 50, the same "ju" word sound is commonly used within the hour and minute blocks. However separate dedicated memories are provided for the word sounds of both the hour values and the minutes values which are to be audibly output.

The prior art electronic voice output device has been satisfactory. However, providing voice data for the different voice sounds for the hours and minutes numbers requires a considerable memory capacity resulting in large chip size leading to a more expensive integrated circuit design. Additionally, voice data must be extremely concise before it can be stored in a memory having limited capacity. Because voice data and tone quality are closely related, the need for conciseness leads to deterioration in tone quality or so severely limits the amount of voice data which may be used that the device becomes impracticable. This becomes even more true in the case of German and Spanish language outputs. Because of the linguistic nature, these languages require an enormous amount of data before they can be used as a medium for electronic audio notification. Accordingly, the prior art system, which only provides for placing data which is directed to the same digit in a single common place, cannot be adapted to a small sized application such as a wrist watch.

For example, if audio time notification is done in the German language, having editing libraries separately provided for the hour numbers and the minute numbers, the amount of data required will then be approximately forty eight words even if word components such as "zig" and "zehn" are stored in a common source such as the use of the "ju" in Japanese Utility Model Publication No. 63-4239. If this data is prepared at a bit rate of 6Kbit/sec, the memory capacity required may be as large of 300Kbit. However, it is only practicable to utilize a device having a 170Kbit memory capacity to provide a system useable in small sized applications.

Accordingly it is desired to provide an electronic audio device which overcomes the disadvantages of the prior art described above by placing the majority of the voice data in a communal data base for several blocks.

SUMMARY OF THE INVENTION

Generally speaking, in accordance with the present invention, an improved electronic voice output device and corresponding audio output methods are provided.

A voice data output device includes a voice data memory for storing voice data corresponding to number sounds to be audibly output. The data is divided into groups of blocks dependent upon the use to which the numbers are to be made such as hour numbers, minute numbers as well as connecting words, the block corresponding to the placement of the word during output. The voice data memory includes a common use memory portion for storing voice data for general blocks and the last block. A word ending memory stores word ending voice data for words with two or more intonation patterns for voice data contained within the general blocks and last blocks. A block only memory stores voice data specific to certain general blocks or the last block. A block voice selector selects the memory from which the words are to be output from among a common use memory, word ending memory and block only memory dependent upon the block in which the data contained in that memory is to be output and the word which is to be output.

Voice data which may be utilized for any of the general block is stored within a commonly used memory. Voice data corresponding only to word endings which have an intonation depending upon the block in which they are used are stored in a word ending memory. Block specific voice data is stored in a block only memory. A memory is selected from which the voice data is to be output from among the commonly used memory, word ending memory and block only memory in accordance with a block type and number to be output. The voice data output are then connected to form a series of numbers such as time notification.

Accordingly, it is an object of the invention to provide an improved voice data output device.

It is another object of the invention to provide a voice output electronic apparatus in which the voice data may be grouped in common memories with greater efficiency.

It is yet another object of the invention to provide a voice output device of reduced size and cost.

A further object of the invention is to provide a voice output device providing audio notification which is more sophisticated in tone quality and natural sound quality and which is capable of outputting long complex words.

Still other objects and advantages of the invention will be in part be obvious and will in part be apparent from the specification.

The invention accordingly comprises the several steps and the relation of one or more of such steps with respect to each of the others, and the apparatus embodying features of construction, combination of elements, and arrangements of parts which are adapted to affect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is a table representation of the voice data memory used for outputting two digit numbers for performing time notification in German;

FIG. 5 is table representation of the voice data memory used for outputting two digit numbers for performing time notification in German;

FIG. 7 is a table representation of the voice data memory used for outputting two digit numbers during time notification in English in accordance with the invention;

FIG. 8 is a table representation of the voice data memory used for outputting two digit numbers for time notification in English in accordance with the invention;

FIG. 10 is a table representation of the voice data memory used for outputting two digit numbers for performing fundamental arithmetic operations in Spanish in accordance with the invention;

FIG. 11 is a table representation of the voice data memory used for outputting two digit numbers for performing fundamental arithmetic operations in Spanish in accordance with the invention;

DETAILED DESCRIPTION OF THE PREFERRED EMBODIMENT

Figure 1:
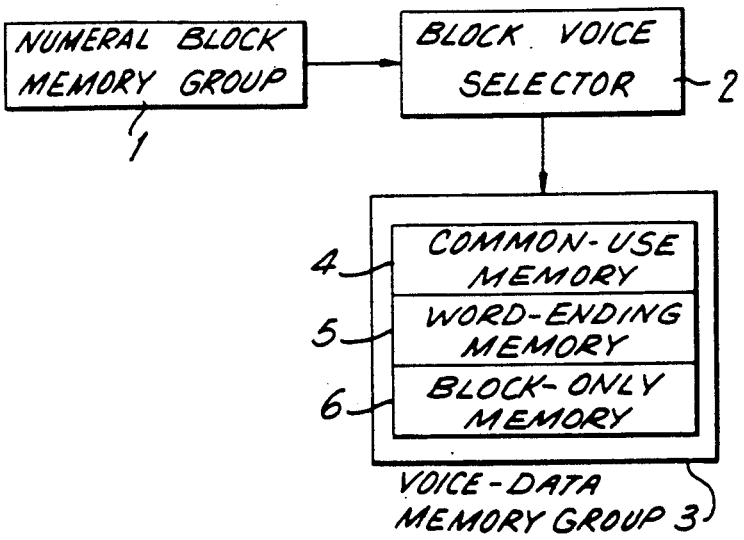
FIG. 1 is a block diagram illustrating a voice output device constructed in accordance with the invention.

In audio time notification, in many languages other than Japanese, the words used to indicate hours and minutes are in many cases the same words. For example, in Japanese while the number four is pronounced "yo" to indicate four hours and "yon" to indicate four minutes, the English, German and Spanish equivalents, "four", "vier" and "cuatro" remain constant independent of the use. However, in English, German and Spanish these numbers undergo intonation changes depending on their block placement in the audio notification. The intonation changes depend on whether they follow or are followed by, another word.

Utilizing the German word "vier", the time "4:04" is pronounced vier Uhr vier. In this instance, the intonation of the first "vier" rises because it is followed by the word "Uhr". The rising "vier" will be referred to as "vier-1". In contrast, the intonation of the last "vier", the vier used to indicate minutes has a lower intonation because it ends the word and is not followed by any other words. The descending intonation "vier" is referred to as "vier-2". When considering another time such as "4:24", pronounced vier Uhr vierundzwanzig, vier-1 is utilized to indicate the hours because as a first word it is followed by the word "Uhr". Accordingly, a rising intonation is needed. However, unlike the first example, the minutes notification does not use the vier-2 with the descending intonation because the placement of vier is followed by the German denomination for twenty. Accordingly, vier-1 utilizing the rising intonation is used to indicate minutes because it is followed by the word component "undzwanzig".

There should be a certain difference between the vier-2 used to indicate hours and the vier-2 used to indicate minutes because the hour vier follows no words whereas the minutes vier follows the word "Uhr". However, because it is clarity in notification that is sought, such a slight differentiation does not have to be taken into consideration. In the German language, the clarity degree is rather low when the tens digit of the minutes notification is 2 or greater as compared to when the tens digit is 1 or 0. Additionally, clarity can be improved by providing a soundless period lasting several tens to several hundreds of millisecond after the "Uhr" notification followed by the outputting of a word with a strong beginning such as used in the hour notification. This combination aides to make the sound more natural. Accordingly, the four used to indicate minutes is vier-1 which is then followed by "undzwanzig".

The word "zwanzig" may also be commonly found in the hours and minutes notification for example, when outputting "military time" such as 20:20 pronounced zwanzig Uhr zwanzig; zwanzig is commonly used for minutes and hours. The word "zwanzig" may be regarded as composed of two word components "zwan" and "zig". The "zig" component is also common to other notification numbers such as the "zig" in "vierzig", "fuenfzig" and the like.

In outputting the hour notification, the "zwan" is the first word sound to be output followed by the ending "zig". The intonation "zig" rises because it is followed by the connector "Uhr". This "zig" is referred to as zig-1. In outputting the minutes notification, the same "zwan" as is used for the hour notification is output securing a high degree of clarity. However, because the ending "zig" of the minutes notification "zwanzig" is followed by no other words the intonation is a descending one so a zig-2 having a descending intonation is utilized. This applies to the numbers 13 through 19 used to indicate military time such as "18:18" pronounced "achtzehn Uhr achtzehn".

Accordingly, in the above example, vier-1 and "zwan" may be stored in an hour minutes common use memory, the ending "zig" in ending memory and the word "Uhr" in a message memory. A block voice selector is used to select the appropriate word sounds for the numbers representing the time which is to be announced and the memory and voice data with which the time notification is to be made, thereby making it possible to utilize common voice data to a high degree providing time notification with high tone quality and a more natural sound using smaller capacity memories.

Reference is first made to FIG. 1 in which a block diagram of an electronic voice output device, generally indicated at 100 constructed in accordance with the invention is provided. A voice data memory group 3 is divided into a common use memory 4 for storing voice data which may be utilized among a plurality of blocks, word ending memory 5 corresponding to voice data for word endings and a block only memory 6 containing block specific voice data. A numerical block memory group 1 outputs numerical values to a block voice selector 2. Block voice selector 2 in response to the numerical value input and the block position of the numerical value will be utilized to select voice data from among the common used memory 4, word ending memory 5 and block only memory 6 to provide a word sound output corresponding to the numerical values.

Figure 2:
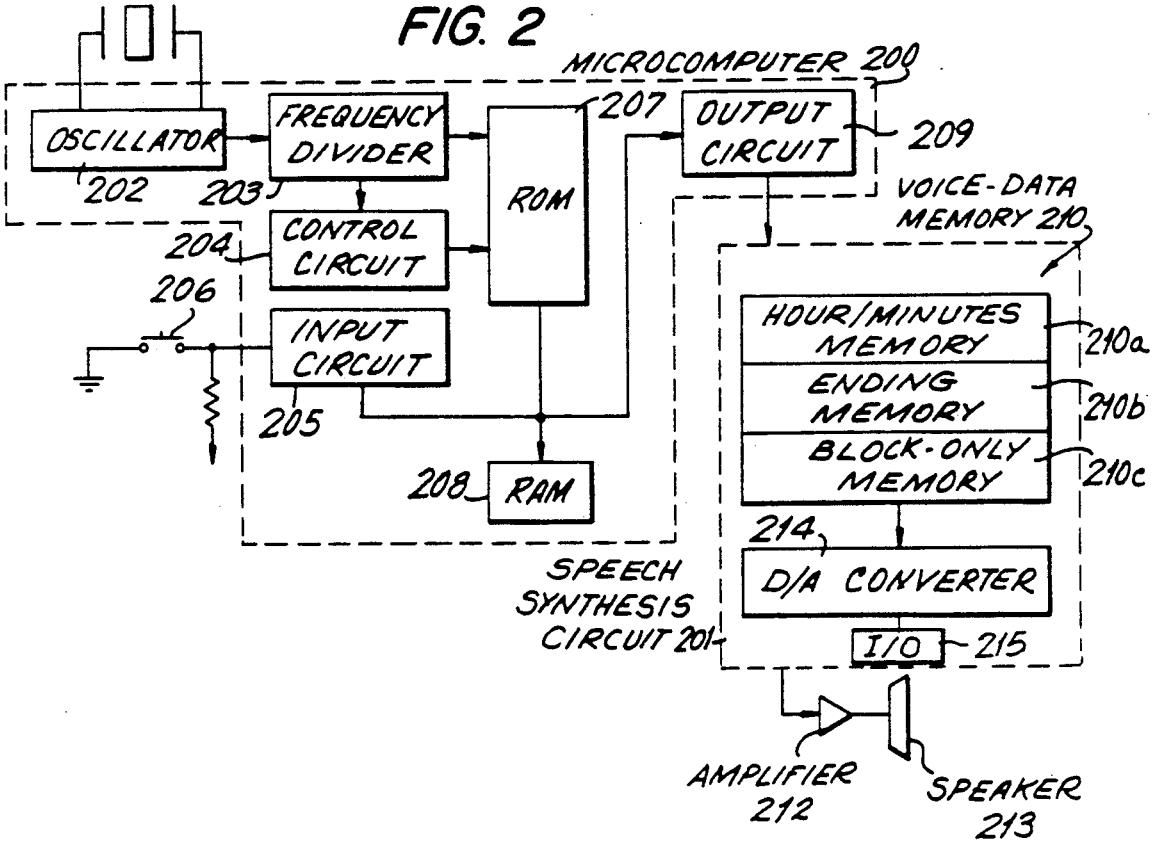
FIG. 2 is a block diagram of the hardware for an audio time notification electronic clock embodying the voice output device constructed in accordance with the invention.

Reference is now made to FIG. 2 in which a block diagram of one embodiment of the invention is provided. A micro-computer 200 provides an output to a speech synthesis circuit 201. Speech synthesis circuit 201 outputs voice data in response to commands from micro-computer 200. The output voice data is processed through an amplifier 212 and a speaker 213. A switch 206 affects time notification (oral announcement of current time) by providing an input to micro-computer 200.

Micro-computer 200 includes an oscillator 202 which provides an output to a frequency divider 203. Frequency divider 203 provides an output to ROM 207. ROM 207 stores the speech synthesis procedures for performing speech synthesis. A control circuit 204 receives an input from frequency divider 203 and provides an output to ROM 207, determines the time in response to the frequency input and controls ROM 207 to output the procedures corresponding to the time. ROM 207 acts on data contained in RAM 208. RAM 208 stores the data for operating the timepiece, such as, switch conditions, alarm activation times, and the working information for arithmetic operations. An input circuit 205 is coupled to switch 206 and an output circuit 209 which provides the control procedures from ROM 207 to speech synthesis circuit 201.

Speech synthesis circuit 201 is an integrated circuit including a voice data memory 210 divided into an hour/minutes memory 210*a*, an ending memory 210*b* and a block only memory 210*c*. The data contained within voice data memory 210 is processed by a digital to analog converter 214 which provides an output to amplifier 212 for producing sound through speaker 213.

When switch 206 is turned on, the voice data selection to produce a voice output is performed in accordance with procedures stored in ROM 207 of micro-computer 200. Commands are output from micro-computer 200 through output circuit 209 so that speech synthesis circuit 201 can perform speech synthesis as specified by micro-computer 200 and output through speaker 213.

Reference is made to the flowchart of FIG. 3 in which the operation of micro-computer 200 for outputting the voice data stored in voice memory data 210 is described in connection with German language time notification. Reference is also made to FIGS. 4 and 5 which show in table form German time notification voice data stored in voice data memory 210. Memory 210 is divided into tables D1 through D6. The data of tables D1 and D2 are used to output both the hour and the minutes notification values and are stored in an hour/minutes memory 210*a*. The data of table D3 is used exclusively for outputting minutes notification and stored in a block only memory 210*c*. The words found in tables D4 and D5 stored in ending memory 210*b* are output as the word endings for the words of table D2. As discussed above, the words zig-1, zig-2 and zehn-1, zehn-2 represent the same words with different intonations dependent on word placement and use. Zig-1 and zehn-1 are used primarily for outputting hour notification and zig-2 and zehn-2 are utilized for outputting minutes notification.

Figure 3:
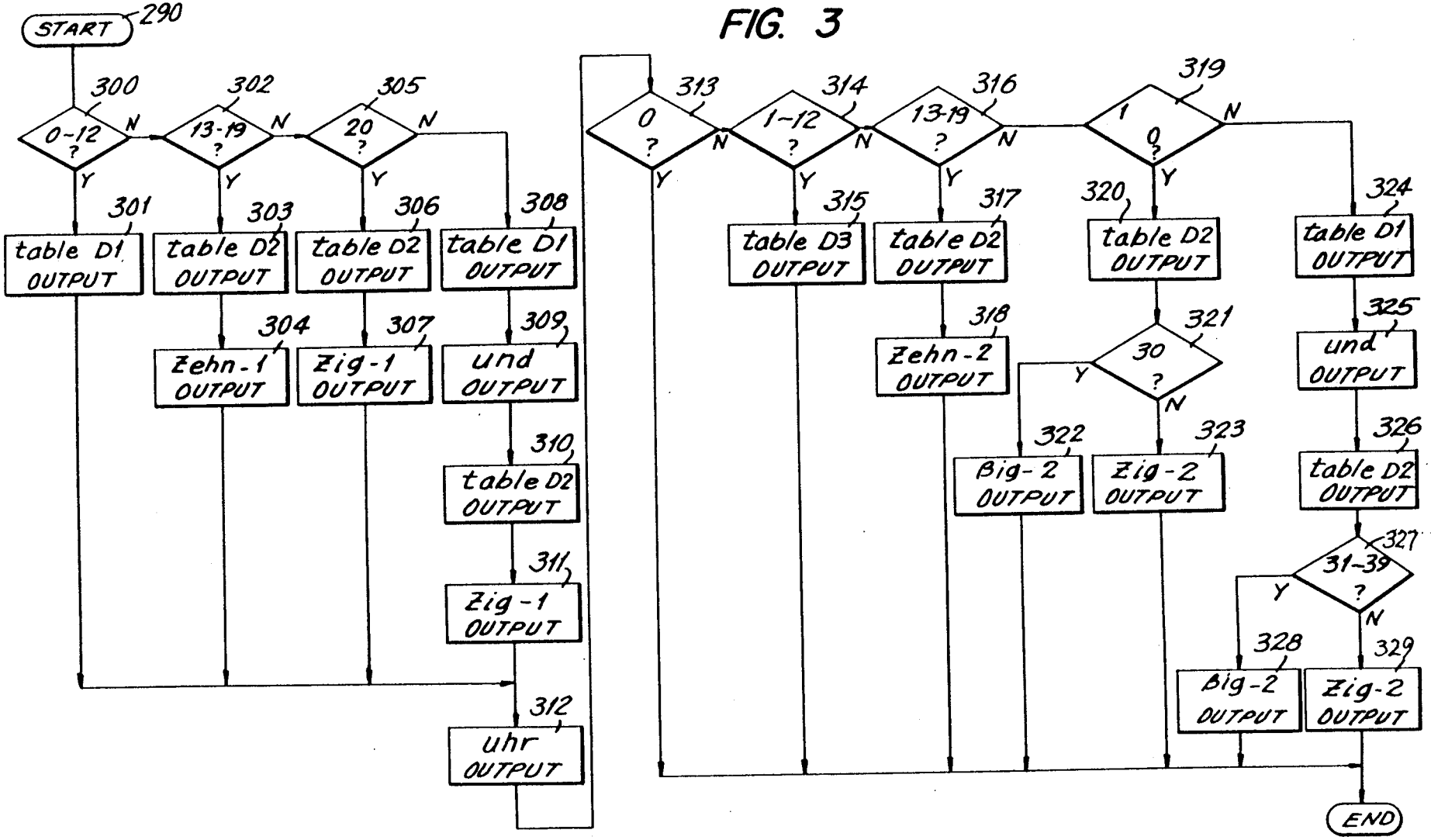
FIG. 3 is a flowchart illustrating the process of audio time notification in German in accordance with the invention.

As seen in FIG. 3 German time notification utilized in the 24-hour or military system is performed using the data set forth in tables D1–D6. The system begins to operate when switch 206 is turned on and an H level input is applied to input circuit 205 in a step 290. A judgement is then made as to whether the hours number falls within the range 0 to 12 in a step 300. If the hours number does fall within that range the word sound corresponding to that hour number is output from table D1 of hour/minute memory 210*a* of voice data memory 210. For example, if the time to be indicated is four o'clock, the word "vier" stored in table D1 is selected and output. If the hour number does not fall within the range 0 to 12, a second judgement is made to determine whether the hour to be indicated falls within the range 13 through 19 in a step 302. If the number does fall within this range the first portion of the word indicating the ones digit of the hour, the word corresponding to the desired number, is selected from table D2 of the hour/minutes memory 210*a* of voice data memory 210 in accordance with the step 303. For example, if the time is 13 o'clock the word "drei" is selected and output. Subsequently, the word "zehn" which is the word ending for numbers 13 through 19 is selected and output. Because it is the hour notification to be output, zehn-1 is selected and output in a step 304 because a rising intonation is required as the hours indication is followed by other words.

If the hour to be indicated does not fall within the range 0 through 19, a judgement is made to determine whether the hour number is 20 in a step 305. If the hour number is 20 the corresponding word component "zwan" is selected and output from table D2 in a step 306. Then the word ending "zig" is output. Because it is the word ending for the hour notification, zig-1 is selected and output from table D4 in step 307. Again, because the ending "zig" is followed by another word a rising intonation is required.

If the hour to be output falls within the range 21 through 23, then in the German language, the ones digit is annunciated first. The unit digit is first selected and output from table D1 in a step 308. The word "und" follows the units digit and is selected from table D6 and output in a step 309. The tens digit number, two in these examples, pronounced "zwan" is selected from table D2 and output in a step 310. After outputting "zwan" the number word ending "zig" is selected and output. Because the hour indication is being output the ending word zig-1 is utilized as it is followed by other words relating to the minutes. To obtain the proper intonation zig-1 is selected from table D4 and output in a step 311. Next, conjunction word "Uhr" corresponding to the Japanese "ji" is selected from table D6 and output in a step 312.

The process is now performed to obtain an oral notification of minutes. It is first determined whether the minutes value is zero in a step 313. If the value is zero there is no notification of minutes. If the value does not equal zero it is determined whether the minutes value falls within the range 1 through 12 in a step 314. If the value does fall within this range, the appropriate word corresponding to the value to be output is selected from table D3 which stores the minute numbers and is output in a step 315.

If the minutes value does not fall within the range 0 through 12 it is determined whether the minutes values falls within the range 13 through 19 in a step 316. When the minutes number falls within the range the corresponding word to be orally output is pronounced with the ones digit being first output and then the ending "zen". Accordingly, the ones digit does not act as the word ending and therefore a common data base for containing the ones digit words for both hours and minutes may be utilized. Accordingly, when the minutes falls within this range the word corresponding to the appropriate ones digit is selected from table D2 which is commonly used to store both the hour and minute indication. The ones digit is then output in a step 317. The ending zehn-2 is selected from table D5 which stores minute ending words and is output in a step 318. Because the "zehn" ending ends the entire audio output zehn-2 must be used to obtain the proper intonation.

If the minute value to be indicated does not fall within the range 0 to 19 it is then determined whether the ones digit of the minute value is a 0 in step 319. If the ones digit is 0 then the minutes number is either 20, 30, 40 or 50. When the number has one of these values the hour/-minutes common use table D2 is used. The word representing the tens digit of the minute number is selected from table D2 and then output in step 320. A second termination is made, determining whether the minutes value is 30 in a step 321. If the minutes value is 30 then the ending word "βig" is selected. The βig-2 word is selected from table D5 and output in step 322. If the minutes value is not 30 minutes then the zig-2 word is selected from table D5 and output in a step 323.

If the minutes values falls within one of the ranges 21 through 29, 31 through 39, 41 through 49 or 51 through 59 the word representing the ones digit is again output first. This allows table D1 used for the hour numbers to also be used to represent the first portion of the word number. This differs from the minutes indication of step 315 for the range of numbers between 1 and 12. Therefore, the first portion of the word is selected from table D1 and output in a step 324. The next word "und" is selected from table D6 and output in a step 325. "und" is followed by the word corresponding to the tens digit of the minutes number. Because this is not the word ending, the first portion of the minute word sound can be selected from table D2 commonly used to indicate hours and minutes. The appropriate word sound is selected from table D2 and output in step 326. In a step 327 it is determined whether the minutes number falls within the range 31 through 39. If the minutes number falls within that range the word ending βig-2 is selected from table D5 and output in a step 328. If the number does not fall within this range then the ending zig-2 is selected from table D5 and output in a step 329. Because these minute endings require downward intonation the data stored in table D5 is utilized.

German differs from English and Spanish in that in German two digit numbers are output by pronouncing the ones digit first. This implies that the output of the ones digit requires three types of ones digit, those corresponding to the hour numbers, those corresponding to the minute numbers within the range 1 through 9 and those corresponding to the minute numbers within the ranges 21 through 29, 31 through 39, 41 through 49 and 51 through 59. However, in the present invention the word intonation of the minute values within the range 21 through 29 for example is close to the word intonations corresponding to the hours numbers because they are both followed by additional words. Accordingly, the same voice data and audio output used for the hour numbers can be employed by the minute numbers greatly improving memory efficiency.

Turning to the English language considering the same example the time 4:04 pronounced four oh four is considered. The first "four" corresponding to the hour number requires an intonation appropriate for a word which is followed by another word. In this case the following word is "oh" and the last "four" requires an intonation appropriate to a word which terminates the sentence. Different word sounds must be provided for the different use of the "four" utilized as an hour indicator and as a minutes indicator. Taking another example, the time 13:13 pronounced "thirteen thirteen", the first "thirteen" corresponding to the hours indication requires a rising intonation since it is followed by the output of the minutes number. On the other hand, the "thirteen" corresponding to the minutes number should have a descending intonation as it closes a sentence. Again, different word sounds should be employed for the two distinct uses of the word "thirteen". However, as in German, a soundless period of several milliseconds improves clarity. Accordingly, the same sound can be used for the word component "third" leaving the difference in intonation to be solely indicated by the word ending "teen". Utilizing another example, the time 21:21 pronounced "twenty-one twenty-one" the same sound can be employed for the first word component "twen" for the reasons discussed above. However, the difference in intonation for the hour and minute numbers makes it impossible to employ the same sound component "ty" even though both tys are followed by a word.

Reference is now made to FIGS. 7 and 8 in which the content of voice data memory 10 used for time notification in English is presented in tabular form. Voice data memory 10 is divided into five portions, tables E1 through E5. Table E1 contains the word sounds for the hour numbers only. Table E3 contains the word sounds for the minute numbers only. Table E2 contains the word sounds for numbers common to both the hour and minute indications. Tables E4 and E5 contain the word sounds for storing word endings for the words in table E2.

Looking closer at tables E4 and E5 the words teen-1 and teen-2, ty-11 and ty-21 and ty-12 and ty-22 correspond to the same words with different intonations. Teen-1, ty-11 and ty-12 of table E4 are used when outputting the hour numbers. Teen-2, ty-21 and ty-22 of table E5 are used for outputting the minute numbers. Ty-11 and ty-21 are used when outputting time notifications in which the ones digit of the minutes number is zero for numbers such as 20, 30, 40 or 50. Ty-12 and ty-22 are used when the ones digit of the minutes numbers fall within the range of 1 through 9.

Figure 6:
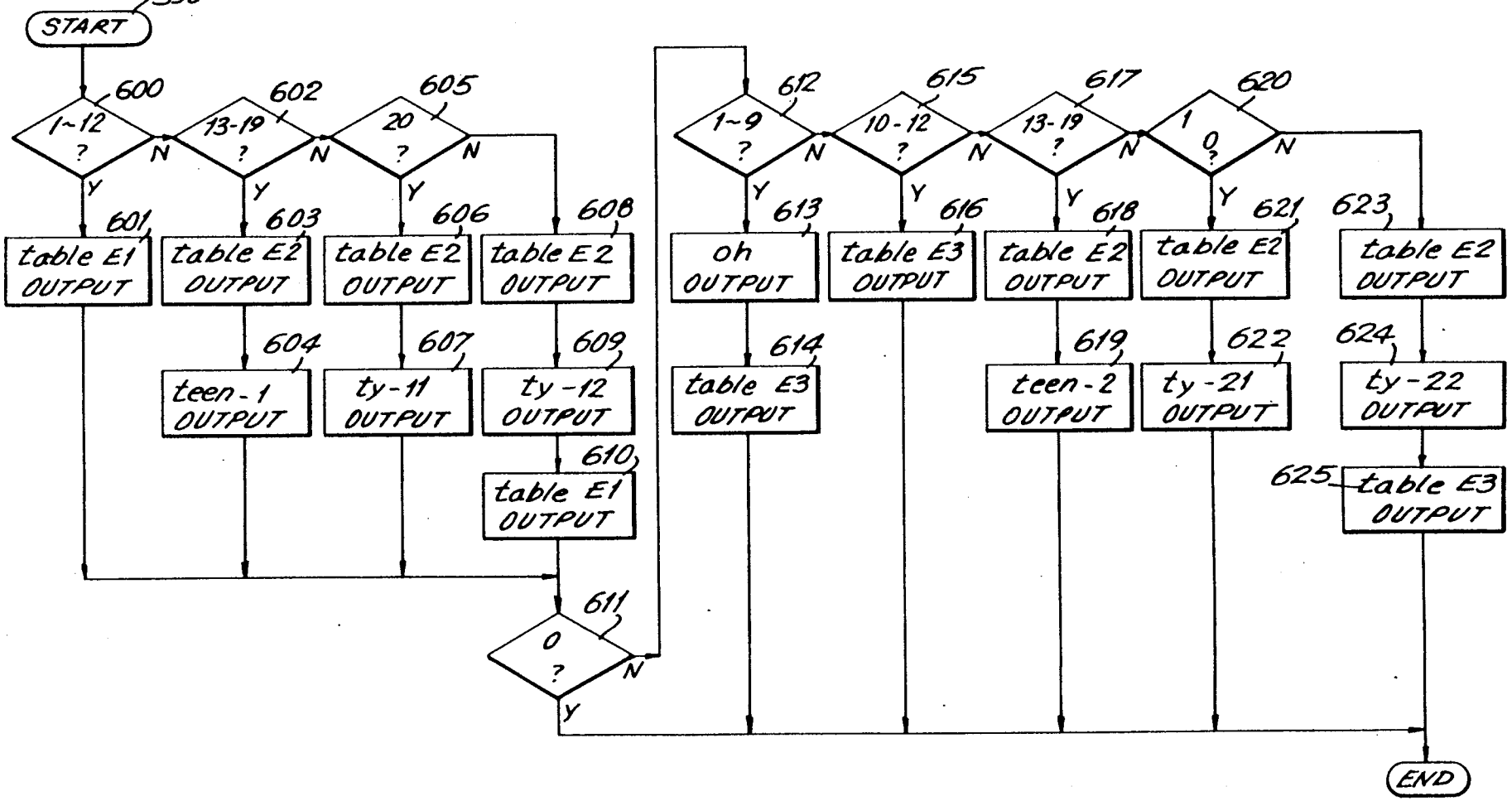
FIG. 6 is a flowchart illustrating the process of audio time notification in English in accordance with the invention.

Reference is now made to FIG. 6 in which a flowchart for outputting voice data contained in tables E1–E5 is provided. The process is begun in a step 590. A first judgement is made to determine whether the hours value falls within the range 1 through 12 in a step 600. If the hour value falls within this range, the appropriate word from table E1 corresponding to the hour value is selected and output in a step 601. For example, if the time is three o'clock, the word "THREE" is selected from table E1 of voice data memory 210 and output.

If the value for the hours does not fall within the range 1 through 12, it is determined whether the value falls within the range 13–19 in a step 602. If the number does fall within the range of 13–19, the appropriate word corresponding to the numerical value is selected from table E2 common to both hours and minutes in voice data memory 210. The word is then output in step 603. For example, in the case of fourteen o'clock the word "four" is selected from table E2 and output. Then the word ending component "teen" is selected. Because the hour number is being output the word teen-1 is selected from table E4 and output in a step 604. This provides the proper intonation for the pronunciation of fourteen o'clock.

If the hour value does not fall within the range 1 through 19 it is determined whether it is twenty o'clock in step 605. If it is twenty o'clock, the word component "twen" is selected from table E2 and output in step 606. The word ending component "ty" is selected from table E4 so that the word ending ty-11 is selected and output in a step 607. When the hours value falls within the range 21 through 24, the word component "twen" of table E2 is selected and output in a step 608. The word ending "ty" is then selected from table E4. Ty-12 is selected and output in a step 609 because the word "twenty" is followed by a ones unit indicator when the hour value falls within a range 21 through 24. The sound for the ones unit of the hour value is then selected from table E1 and output in a step 610.

It is then determined whether the time has a minutes component in a step 611. The minutes number is then output if one does exist. It is determined whether the minutes value lies within the range 1 through 9 in step 612. If the minutes value falls within this range the connection word "oh" found in table E3 is output in a step 613. This is then followed by the minute value which is selected from table E3 containing the ones digit minute values and output in a step 614.

If the minutes value does not fall within the range 1 through 9 it is determined whether it falls within the range 10 through 12 in a step 615. If the minutes value does fall within this range the appropriate corresponding word output is selected from E3 and output in a step 616.

If the minutes value does not fall within the range 1 through 12, it is determined whether it falls within the range 13 through 19 in a step 617. If the minutes number falls within the range 13 through 19, the front portion of the corresponding word sound is selected from table E2 which is common to both the hours and minutes numbers. The selected word sound is then output in a step 618. The wording ending "teen" is then selected from table E5 and output in a step 619. Teen-2 is output to provide the proper intonation for the last word in the notification sentence.

If the minutes value does not fall within the range 1–19, it is determined whether the ones digit of the minutes value is zero in step 620. If the ones digit is zero, it corresponds to the minutes values 20, 30, 40 or 50. The front half of the word sound corresponding to these numbers is selected from Table E2, common to both hours and minutes and output in a step 621. Then ending ty-21 corresponding to the minutes word ending when the minutes word ends a sentence is selected from Table E5 and output in step 622. When the minutes number falls within the ranges 21–29, 31–39, 41–49 or 51–59, the word sound corresponding to the tens digit is selected from Table E2 for both the hours and minutes word sounds and is output in a step 623. Next the word ending ty-22 of Table E5, having a different accent than the "ty" ending when terminating the entire output is selected and output in a step 624. Next the sound of the number corresponding to the ones digit is output from Table E3 for minutes numbers only in a step 625 a it is not followed by any other words. Word sounds ty-11 and ty-22, and ty-21, ty-22 are treated as distinct word sounds in this example, however, it is also possible to store and use them at a common source.

Figure 9:
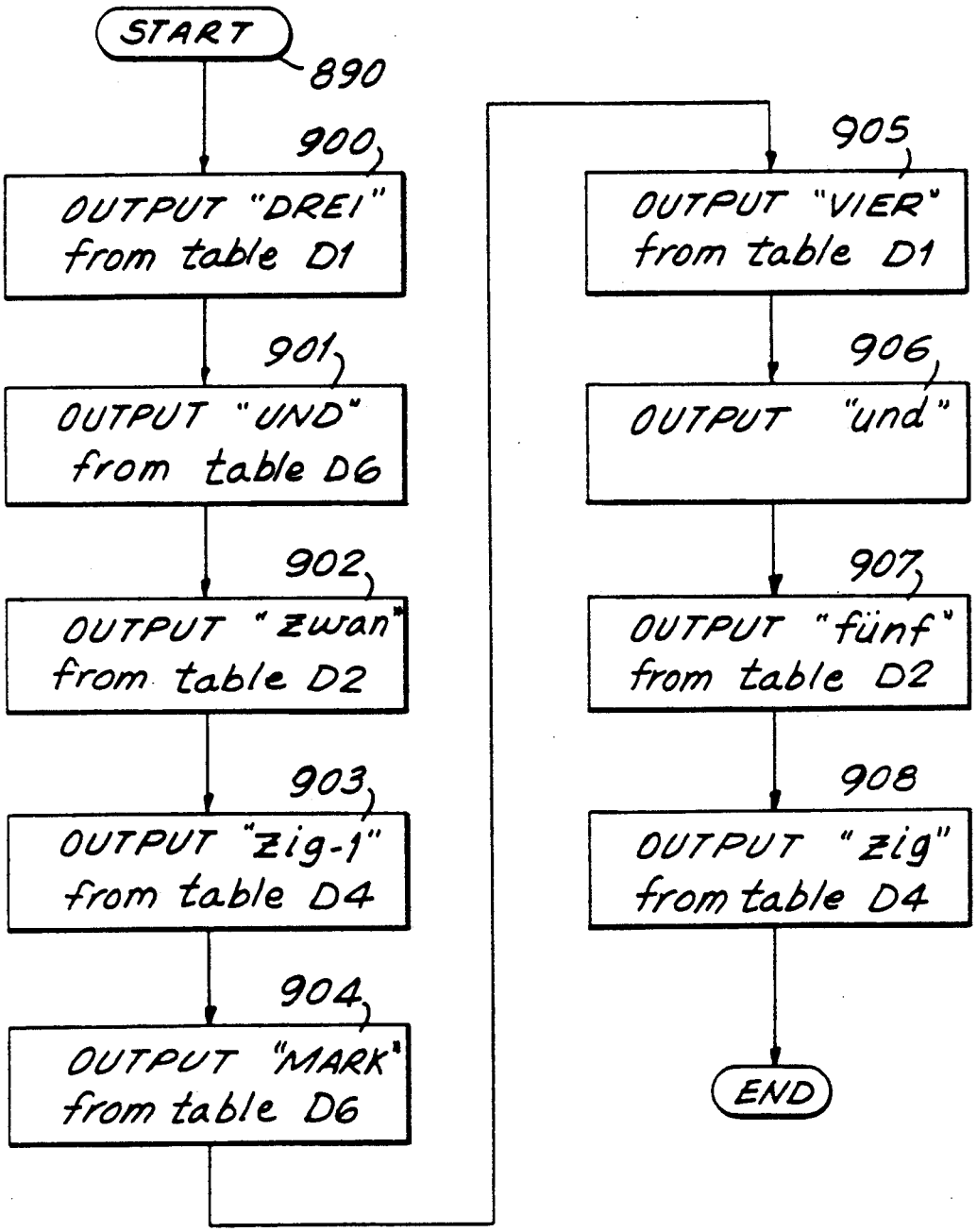
FIG. 9 is a flowchart illustrating audio monetary notification in the German language in accordance with the invention.

The above embodiments have been directed to time notification in German and English. However, the invention is not limited to such applications, but can also be utilized in other numerical local output devices such as announcing numbers and totals at cash registers or the like. By way of example, reference is made to FIG. 9 in which the reading out of a sum is performed in German. The voice data memories of Tables D1–D6 are utilized.

For example, the sum twenty three Mark and fifty four Pfennig (23.54 DM) pronounced Dreiundzwanzig Mark, Vierundfuenfzig is read aloud. For this example, the Marks Value is treated in the same way as the hours number and the Pfennig value is utilized in the same way as the minutes number.

The oral output of the sound is begun in a step 890. The first part of the word "DREI" is selected from Table D1 and output in a step 900. The word "und" is selected from Table D6 and output in a step 901. Then the first word portions "zwan" is selected from Table D2 and output in a step 902. Next the ending zig-1 of Table D4 having a rising intonation is selected and output in a step 903 following the output of "zwan". A rising intonation is required because as in the hour notification the Mark notification is followed by other words. The word sound "MARK" is selected from Table D6 and output in a step 904. To output the Pfennig words, the word "VER" is selected from Table D1 and output in a step 905. Next the connecting word "und" is selected and output in a step 906. The tens digit is then output and the word sound "fuenf" is selected from Table D2 and output in a step 907. The word ending for the tens digit zig-2 is selected from Table D4 and output in a step. Zig-2 is selected because of its descending intonation which is required when no other word sounds follow. The word "Pfennig" need not be output.

Figure 12:
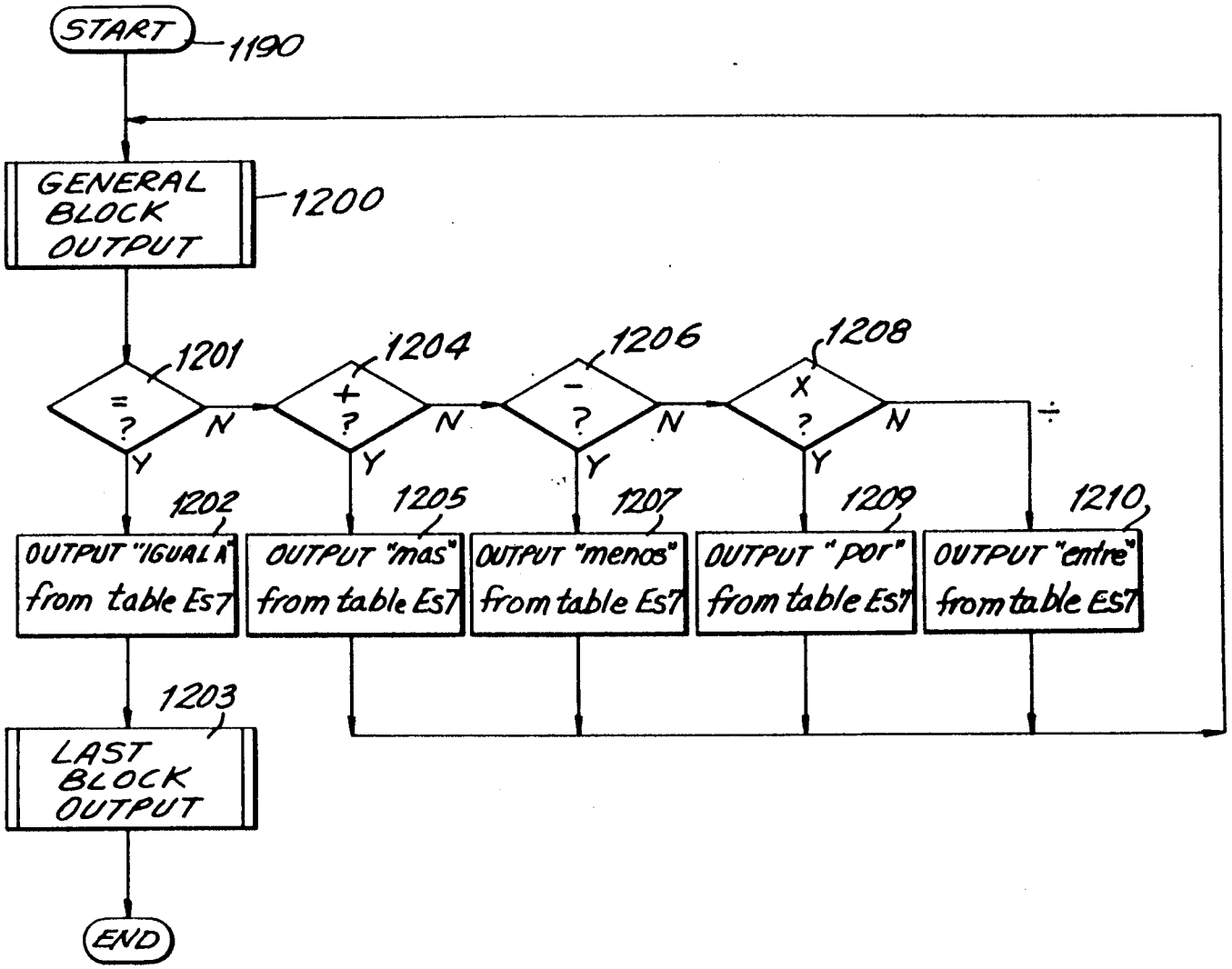
FIG. 12 is a flowchart illustrating the process of outputting operational expressions for fundamental arithmetic operations in Spanish.
Figure 13:
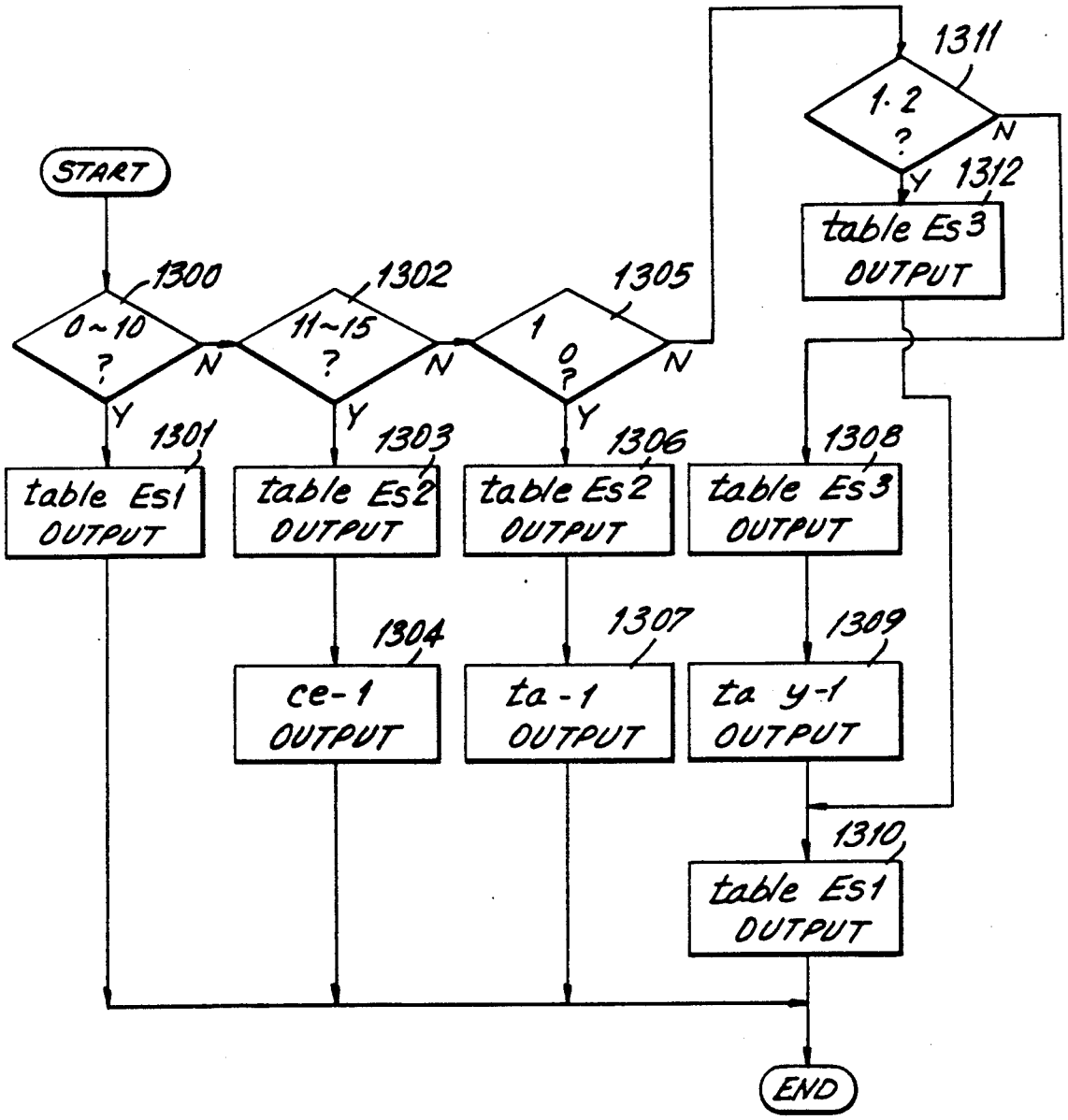
FIG. 13 is a flowchart illustrating the process of outputting operational expressions for fundamental arithmetic operations in Spanish.
Figure 14:
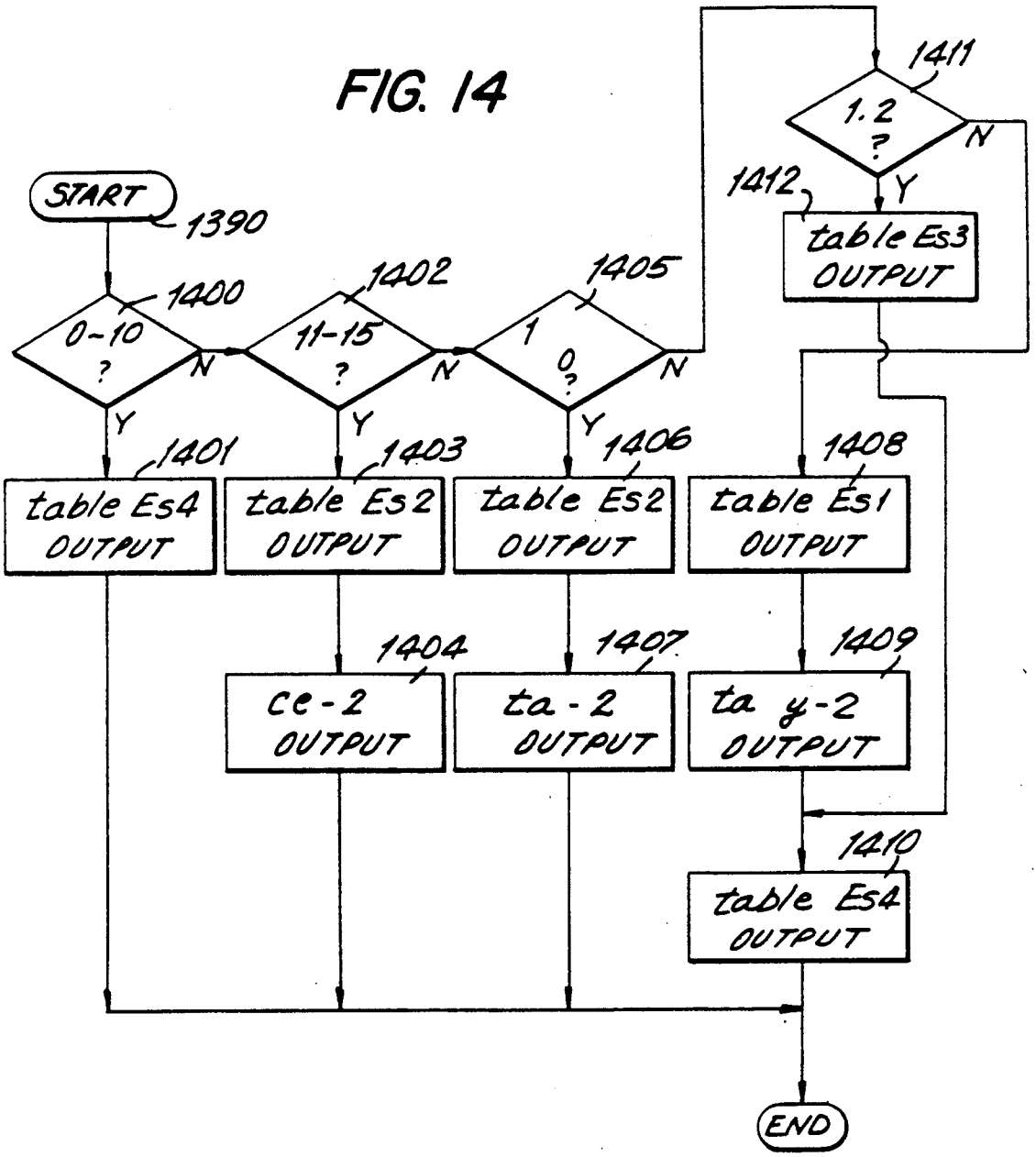
FIG. 14 is a flowchart illustrating the process of outputting operational expressions for fundamental arithmetic operations in Spanish.

The invention may also applied to the case where computer operations are read aloud. Reference is now made to FIGS. 10–14 wherein an example of reading aloud of arithmetic operations utilizing Spanish is provided. FIGS. 10 and 11 show a Spanish word library in tabular form used for the fundamental arithmetic operations where the numbers used in the formulas are natural numbers of two digits or less or zero. FIGS. 12, 13 and 14 illustrate the process of voice outputting arithmetic operations in Spanish using this library found in voice data memory 210. For example, the operation N1+N2=N3 is to be output, N1 and N2 are numbers contained in the general block, whereas N3 represents numbers of the last block. Table Es1 constitutes a data memory for a general block. Table Es4 is a data memory for the last block. Tables Es2 and Es3 are data memories common for all of the blocks. Tables Es5, Es6 and Es7 contain word ending sounds.

Specifically referring to FIG. 12, a process is begun in a step 1190. The word sounds of the general block corresponding to the value of the N1 number are first output in a step 1200. A determination is then made whether or not the operator to be utilized is "equals" in a step 1201. Because the N1 value is the first value the equals operation is not utilized and a judgment is made whether the addition operator is to be used in a step 1204. If the addition operator is being used, then the word sound "mas" selected from Table Es7 is output in a step 1205. If the addition operation is not being performed, then it must be determined whether a subtraction operation is being performed in a step 1206. If a subtraction operation is being performed then the word sound corresponding to subtraction, "menos", is selected from Table Es7 and output in step 1207. If subtraction operation is not being performed then a decision is made whether the multiplication operation is being performed in a step 1208. If the multiplication process is being performed, then the corresponding word sound to indicate multiplication, "por", is selected from Table Es7 and output in a step 1209. If division is being carried out then the corresponding word sound "entre" is selected from Table Es7 and output in a step 1210. Next, the word sound corresponding to the numerical value N2 which is being operated on is selected and output for the general block in accordance with a step 1200. Next the judgment is made that an equal operation is being performed in step 1201 and the word sound "igual a" is selected from table Es7 and output in a step 1202. The sound corresponding to the value obtained in the process, N3, is selected for the last block and output in a step 1203.

Reference is now made to FIG. 13 in which the process for outputting the values of the general block in step 1200 is depicted. A first judgment is made whether the number to be output has a value between 0 and 10 in a step 1300. When the general block number falls within this range, the word sound corresponding to that number is selected from Table Es1 and output in step 1301. If the value does not fall in the range 0–10 it is determined whether it falls within the range 11–15 in a step 1302. When the number falls within this range, the corresponding word sound may be broken into two word portions. The sound for the first word portion is selected from Table Es2 and output in a step 1303. Then, the general block ending selected from table Es5 is output in step 1304. If the value does not fall within the range 11 through 15 a determination is made as to whether the ones digit is zero in a step 1305. If the ones digit is a zero then the numerical value of N1 corresponds to 10, 20, 30, 40, 50, 60, 70, 80, or 90. The sound of the numeric component corresponding to the tens digit figure is then selected from table Es2 and output in a step 1306. Then the general block ending ty-1 is selected from table Es5 and output in a step 1307. If the tens digit has the value of a one or a two as determined in step 1311 the data from table Es3 is output in a step 1312. The ones digit sound is then output from table Es1. If both the tens digit is greater than two and the ones digit of the number falls within the range 1 to 9 as with the value 31 through 39, the sound for the tens digit is selected from table Es3 and output in a step 1308. In Spanish the tens digit contains a word ending as well as a conjunction pronounced "ta y". Accordingly, the sound ta y-1 is selected from table Es5 and output in a step 1309. The sound of the ones digit is then selected from table Es1 and output in a step 1310.

Reference is now made to FIG. 14 in which the process for outputting the sound corresponding to the last block output in step 1203 is provided. The process is begun in a step 1390. A judgement is made to determine whether the value N3 falls within the range 0 through 10. When the last block number has a value within the range 1 through 10 the sound corresponding to that value is selected from table Es4 and output in a step 1401. If the value of number N3 does not fall within that range then it is determined whether the value falls within the range 11 through 15 in a step 1402. If the number does fall within this range, the sound corresponding to the first portion of the corresponding word is selected from table Es2 and output in a step 1403. The last block ending sound "ce" is then output to complete the word. The sound ce-2 is selected from table Es6 and output in a step 1404. Ce-2 is output due to the requirement for a descending intonation appropriate for the last block output.

If the value of N3 is greater than 15, a judgement is made to determine whether the ones digit of the value is 0. If the ones digit is 0 then the number is one of the group 20, 30, 40, 50, 60, 70, 80 and 90. If the value of N3 is within this group then the sound component corresponding to the tens digit of the value to be output is selected from table Es2 and output in a step 1406. The ending sound for that value "ta" is then selected. Ta-2 is selected from table Es6 due to its descending intonation and output in a step 1407. If the tens digit has the value of one or two as determined in a step 1411, the sound from table Es3 is output in a step 1412. The sound for the ones digit is then output from table Es4 in a step 1410. When the value for the tens digit is greater than two and the value of the ones digit of N3 falls within the range 1 through 9 for example when the number is 31 through 39, the sound corresponding to the front portion of the tens digit is selected from table Es2 and is output in a step 1408. As discussed above, the sound "ta y" is utilized in Spanish as ending and conjunction for two digit numbers in this range. Sound ta y-2 is selected from table Es6 and output in step 1409. The sound corresponding to the ones digit for the value is then selected from table Es4 and output in a step 1408. In Spanish, a problem occurs in numbers such as thirty-one which is pronounced "treinta y uno". The "ta" in "treinta" and the "y" are closely connected with each other. Furthermore, different sounds should be employed for the "treinta" of thirty and the "treinta" of thirty-one. Accordingly, the "ta" and "y" are always coupled with each other. Accordingly, by regarding the two dramatically independent words as a single word, they can be treated by a micro-computer or the like as a single word or sound instead of two distinct words simplifying the process.

By providing an electronic voice output device having a common use memory for storing sounds corresponding to words which are common to all the blocks, a word ending memory for storing sound only associated with the word endings of the words forming the blocks and a block only memory for storing block specific word sounds and determining whether or not the word sound to be output belongs to the general or last block specifying the location in the memory from which the word sound corresponding to the number to be output is selected in accordance with the block type under consideration, voice data can be efficiently coded making it possible to realize audio notification with better tone quality. This allows voice output electronic devices to be made on a smaller scale making it more adaptable to devices using smaller integrated circuits, smaller memories making the device extremely applicable to small electronic devices such as a watch having an audio time notification system.

Additionally, such small audio time notification devices require concise voice data. However, as in the prior art audio clock using long words or a large vocabulary by simple voice coding deteriorates clarity and tone quality. Conversely, to provide clarity and tone quality a large memory is required. By providing a common use memory usable in all of the output blocks, and by storing word sections having sound such as commonly shared by a number of words when regarded as sound tone quality and clarity are provided without increasing memory capacity. Additionally, by providing commonly shared sounds in common memory and sounds incapable of being placed in a common memory in their own respective individual memories, memory efficiency is improved making it possible to provide a voice output electronic apparatus overcoming the size and clarity problems of the prior devices. For example, in German time notification, the amount of voice data required can be as small as thirty seconds whereas the voice data amount as great as 50 to 60 seconds would be necessary if data was separately prepared for the values of the hour and minute blocks. Accordingly, integrated circuit size can be made of a smaller design resulting in a lower overall chip cost and a lower cost audio time notification clock.

It will thus be seen that the objects set forth above, among those made apparent from the preceding description, are efficiently attained and since certain changes may be made in carrying out the above method and in constructions without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language might be said to fall therebetween.

What is claimed is:

1. An apparatus for audibly outputting a series of numbers represented by words, the words being divided into blocks of sound, said blocks of sound being serially connected and including at least two general blocks and a last block at the end of the series of numbers to be output, the blocks being connected to form an audio output of the series of numbers comprising:

a voice data memory group for storing voice data to be utilized in connection with said blocks of sound, the voice data memory group including commonly used memory means for storing voice data which may be utilized for at least one of the general blocks, word ending memory means for storing voice data corresponding to word endings having at least two distinct intonations, and block only memory means for storing voice data which is only used for one of the general blocks of last block; and block voice selecting means for selecting a memory means from which the voice data is to be output from among the commonly used memory means, word ending memory means and the block only memory means in accordance with the block type and the number to be output, the voice data stored in said block only memory means being a subset of at least a portion of said voice data stored in said commonly used memory means, said voice data stored in said block only memory means differentiating from said portion of said voice data stored in said commonly stored memory means in intonation only and the voice data stored in said word ending memory means being stored as a first set of voice data and a second set of voice data, said first set of voice data differentiating from said second set of voice data in intonation only.

2. The apparatus for audio outputting a series of numbers of claim 1, wherein voice data stored in the word ending memory has an intonation when used in the general block different from the intonation when used in the last block.

3. The apparatus for audio outputting a series of numbers of claim 1 further comprising connecting words provided in blocks intermediate the blocks connected to form the audio output.

4. The apparatus for audio outputting a series of numbers of claim 1, wherein said voice data includes sounds corresponding to the words representing said numbers.

5. The apparatus for audio outputting a series of numbers of claim 1, wherein said apparatus is an audio notification timepiece.

6. A method of producing an audio output of a series of numbers represented by words and connected words, the words being divided into blocks of sound, said blocks of sound being serially connected, the blocks including at least two general blocks and a last block comprising the steps of:

storing voice data which may be utilized for at least two of the general blocks within a commonly used memory;

storing voice data corresponding to word endings having at least two distinct intonations in a word ending memory;

storing voice data which may be used only for one of the general blocks or the last block only memory;

selecting a memory from which voice data is to be output from among the commonly used memory, word ending memory, and block only memory in accordance with the block type and number to be output, the voice data stored in said block only memory means being a subset of at least a portion of said voice data stored in said commonly used memory means, said voice data stored in said block only memory means differentiating from said portion of said voice data stored in said commonly stored memory means in intonation only and the voice data stored in said word ending memory means being stored as a first set of voice data and a second set of voice data, said first set of voice data differentiating from said second set of voice data in intonation only; and connecting the voice data from selected memories to form a series of numbers.

7. The method of claim 6, further comprising the steps of storing voice data corresponding to connecting word sounds in the block only memory.

8. The method of claim 6, wherein the voice data includes word sounds corresponding to the number to be output for the block.

9. The method of claim 6, wherein the general blocks includes a first block, the voice data corresponding to the output of the first block being stored in a block only memory having a rising intonation.

10. The method of claim 9, wherein the voice data stored in the word ending memory corresponds to the word sound having either a raising intonation or a descending intonation, and further comprising the step of outputting the word sound having a descending intonation when providing an output for the last block.

11. The method of claim 6, wherein the numbers to be output falls in the range of 0 to 100 and include a prefix portion and a suffix portion, and including the steps of storing the prefixes for a portion of the numbers in the commonly used memory and the prefix for a portion of the words in the block only memory

12. The method of claim 10, wherein the language is English and further comprising the steps of determining whether the number to be output is greater than twelve and storing the prefix of the numbers greater than twelve in the commonly used memory.

13. The method of claim 10, wherein the numbers to be output are output in Spanish and further including the steps of determining whether the value to be output is greater than ten, and storing the prefix of the numbers greater than ten in the commonly used memory.

14. The method of claim 10, wherein the numbers to be output are output in German comprising the steps of determining whether the number to be output falls within the range thirteen through nineteen or is greater than ten and has no value for the ones digit and storing the prefix of these numbers in the commonly used memory.

15. The method of claim 14, further comprising the step of storing the number value within the range of zero and twelve to be output for a general block and the number value within the range twenty one through twenty nine, thirty one through thirty nine, forty one through forty nine, and fifty one through fifty nine to be output in the last block in a second commonly used memory.

* * * * *